United States Patent [19]

Gruenberg

[11] Patent Number: 4,955,828

[45] Date of Patent: Sep. 11, 1990

[54] MULTIPLE CONTACT COAXIAL SHELL CONNECTOR

[75] Inventor: Eric Gruenberg, Soquel, Calif.

[73] Assignee: Apple Computer, Inc., Cupertino, Calif.

[21] Appl. No.: 434,645

[22] Filed: Nov. 9, 1989

[51] Int. Cl.[5] ..... H01R 17/18

[52] U.S. Cl. ..... 439/668; 439/675

[58] Field of Search ..... 439/825, 826, 668, 669, 439/20, 23–26, 28, 675, 578, 13, 21

[56] References Cited

U.S. PATENT DOCUMENTS

| | | | |
|---|---|---|---|
| 2,277,212 | 3/1942 | Cunningham | 439/826 |
| 3,497,866 | 2/1970 | Patton | 439/668 |
| 3,936,116 | 2/1976 | Spinner | 439/20 |

FOREIGN PATENT DOCUMENTS

| | | | |
|---|---|---|---|
| 755271 | 3/1967 | Canada | 439/669 |
| 2743406 | 5/1978 | Fed. Rep. of Germany | 439/669 |
| 0805728 | 12/1958 | United Kingdom | 439/669 |

*Primary Examiner*—David L. Pirlot
*Attorney, Agent, or Firm*—Mark Aaker

[57] ABSTRACT

A multiple contact coaxial shell connector combines coaxial, shielded, and multiple contacts in a single connector which need not have angular orientation before mating. The connector is formed by a post, shell, and connector body. The post is formed as an insulating contact-carrying post having multiple electrical contact bands spaced along the length of the post. The post is surrounded by one or more shells, where each shell is formed as an insulating contact-carrying shell coaxially encircling and spaced from the post, each shell having multiple electrical contact rings spaced along the length of the shell. The shell can also contain a encircling shielding layer. The post and shell are mounted at one end to a connector body, leaving the other end open for access to the multiple contacts by a matching socket. The socket has complementary recesses to mate to the connector post and shell, and has leaf spring contacts to contact the multiple contact rings and bands of the post and shell.

19 Claims, 3 Drawing Sheets

MULTIPLE CONTACT COAXIAL SHELL CONNECTOR

BACKGROUND OF THE INVENTION

This invention relates to an electrical connector having multiple contacts within a coaxial shell, in which the connector does not require a specific angular orientation before coupling to a mating socket.

Coaxial connectors are known in the field and are useful for signals of high frequencies or high signaling rates. Coaxial connectors also provide a shield around the connector to prevent the egress or ingress of signals or noise.

Connectors with multiple contacts are known in many forms for connecting power or signals of low signaling rates such as might be carried on "twisted pair" wiring. However, no connector is known which is both coaxial and has a large number of contacts.

Connectors which do not require angular orientation before mating are also known in the field, such as the standard stero headphone plug or the PL-259 coaxial connector. However, no connector is known which combines coaxial, multiple contacts and non-orientation characteristics in a single connector.

SUMMARY OF THE INVENTION

This invention provides a multiple contact coaxial shell connector which combines coaxial, shielded, and multiple contacts in a single connector which need not be oriented before mating.

This connector is formed by a post, shell, and connector body. The post is formed as an insulating contact-carrying post having multiple electrical contact bands spaced along the length of the post.

The post is surrounded by one or more shells, where each shell is formed as an insulating contact-carrying shell coaxially encircling and spaced from the post, each shell having multiple electrical contact rings spaced along the length of the shell. The shell can also contain a encircling shielding layer. The use of increasing diameter encircling shells allows a rapid increase in the number of contacts, without increasing the length required, and only a uniform step increase in the diameter required.

The post and shell are mounted at one end to a connector body, leaving the other end open for access to the multiple contacts by a matching socket. The socket has complementary recesses to mate to the connector post and shell, and has cantilever spring or leaf spring contacts to contact the multiple contact rings and bands of the post and shell.

This connector provides the combination of coaxial, shielded, and multiple contacts in a connector which does not require orientation before mating. This type of connector is very advantageous, for example, in connecting to a portable computer where multiple types of power and data communication contacts need to be made when the computer is at a fixed location such as a desktop, but where the computer is frequently disconnected for carrying about. With the connector of this invention, all the connections can be made through a single connector, and the connector is easy to use, as it does not have to be oriented before each coupling.

DETAILED DESCRIPTION

Figure 1:
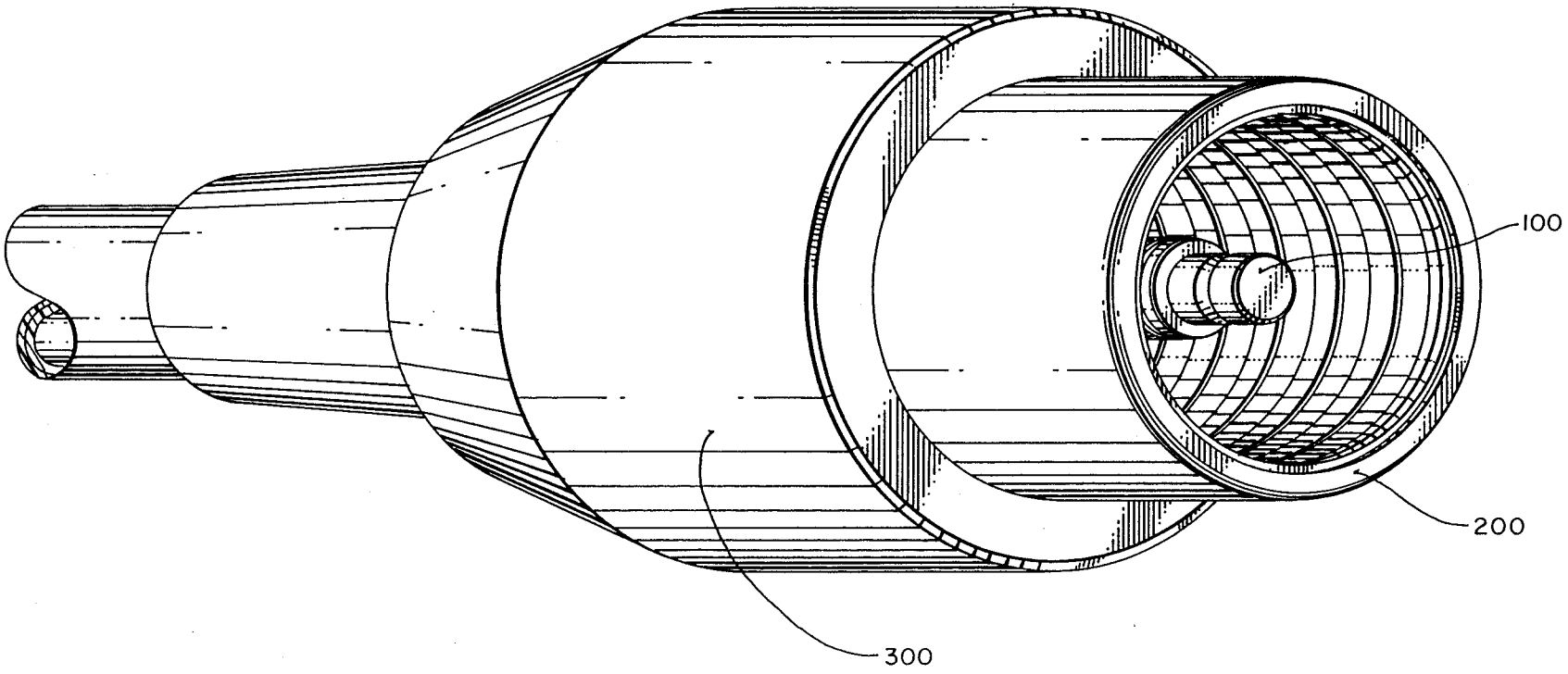
FIG. 1 shows a perspective view of a preferred embodiment of the connector of this invention.

FIG. 1 shows a perspective view of a preferred embodiment of the connector of this invention. The connector includes a post 100, shell 200, and connector body 300. This embodiment provides eleven separate electrical contacts, five on the post 100, and six on the shell 200, as well as a coaxial shield.

Figure 2:
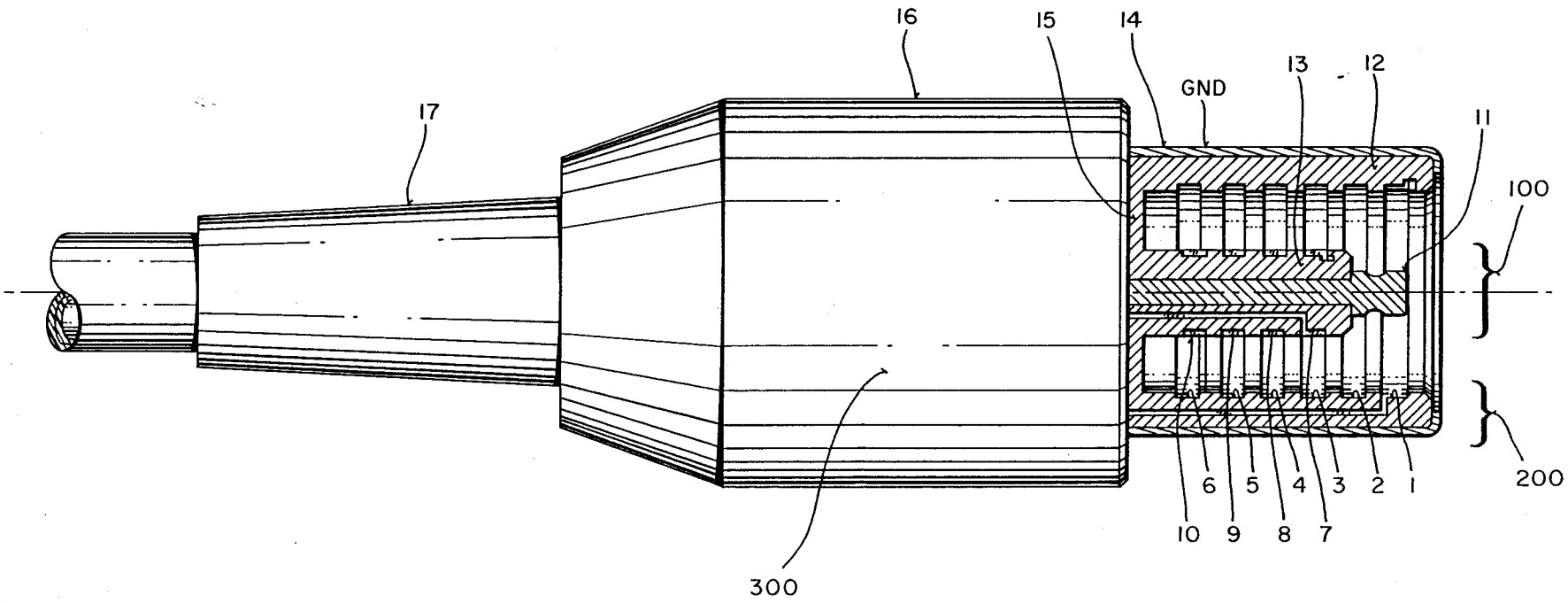
FIG. 2 shows a sectional view of a preferred embodiment of the connector of this invention.

FIG. 2 shows a sectional view of a preferred embodiment of the connector of this invention. Post 100 is formed by an insulator post 13 carrying multiple electrically conductive contact bands 7, 8, 9, and 10. In other embodiments, more or fewer contact bands can be used. Each band encircles the insulator post 13, and is separated from its neighboring bands and longitudinally spaced along the length of the insulator post 13. The bands can be formed conforming or flush to the outer surface of insulator post 13.

Each band has an electrically conductive signal feed running within insulator post 13 from the band to a terminal within the connector body 300. In the sectional view of FIG. 2, only the signal feed for band 7 is visible, as the other signal feeds are spaced and located at other angular orientations, such as every 90 degrees for four bands, around the central axis and within the insulator post 13. The use of embedded and offset positioning of the signal feeds allows a large number of contacts to be fabricated on a post without a "buildup" or excessive increase in the thickness or diameter required by the post. Such a post assembly can be fabricated by positioning the bands at proper linear spacings, and orienting the respective signal feeds at different angular orientations down the center of the bands, and then holding the signal feeds in these orientations by injection molding insulating plastic.

Post 100 also has an electrically conductive dimpled contact tip 11 on the end of insulator post 13 with its signal feed running down the center axis of insulator post 13 to a terminal within connector body 300. This contact tip 13 and signal feed are of a larger size and cross sectional area than the other contact bands and signal feeds, and can be used to carry the higher current positive power supply connection through the connector.

Shell 200 is formed of an insulator shell 12 carrying multiple electrically conductive contact rings 1, 2, 3, 4, 5, and 6. In other embodiments, fewer or more contact bands can be used. As shown, each ring encircles the inner diameter of the shell 12, and is separated from its neighboring rings and longitudinally spaced along the length of the insulator shell 12. The rings can be formed conforming or flush to the inner or outer surface of insulator shell 12. In the embodiment shown in FIG. 2, the rings are formed flush to the inner diameter of insulator shell 12, and the outer diameter of insulator 12 is covered with an electrically conductive tubular shield 14.

Each ring has an electrically conductive signal feed running within insulator shell 12 from the ring to a terminal within the connector body 300. In the particular sectional view of FIG. 2, only the signal feed for ring 1 is visible, as the other signal feeds are spaced and located at other angular orientations, such as separations by 45 degrees, around and within the insulator shell 12. In other embodiments, a second or third shell of larger diameters can be used to provide additional contacts or shields to a connector. The large area shield 14 can be used as the ground return connection for signal and power supply currents. It is also preferred that contacts on the post 100 do not project beyond the end of the shield 14 so that contacts are protected from inadvertent contact when the connector lays on a surface or rests against objects. In other embodiments, additional contact rings can be used in place of a shield.

Post 100 and shell 200 are open at one end for access to the multiple contact rings and bands by the mating socket, and are closed at the other end for connection to connector body 300. Connector body 300 holds the post 100 centered within the shell 200, for example by connecting insulating post 13 and insulating shell 12 by an insulating body 15. Signal feeds from the contact rings and bands terminate at terminal areas within connector body 300 for connection to cables leading from the connector to external equipment. The terminals and cable ends can be covered by a cap 16 and holder 17. In other embodiments, the connector could be formed for mounting on the panel or case of a piece of equipment.

To fabricate the connector, the following materials are preferred. Insulating materials can be formed of injection molded plastic. Electrical contact wipers can be formed of copper alloys such as beryllium copper or phosphor bronze. Contact areas such as contact bands or rings can have gold over nickel plating on brass, although harder materials may be preferable for reducing wear in high duty cycle applications. Terminal areas can have tin over nickel plating on brass. Shields can be formed of steel. The cap and holder can be formed of flexible rubber.

Figure 3:
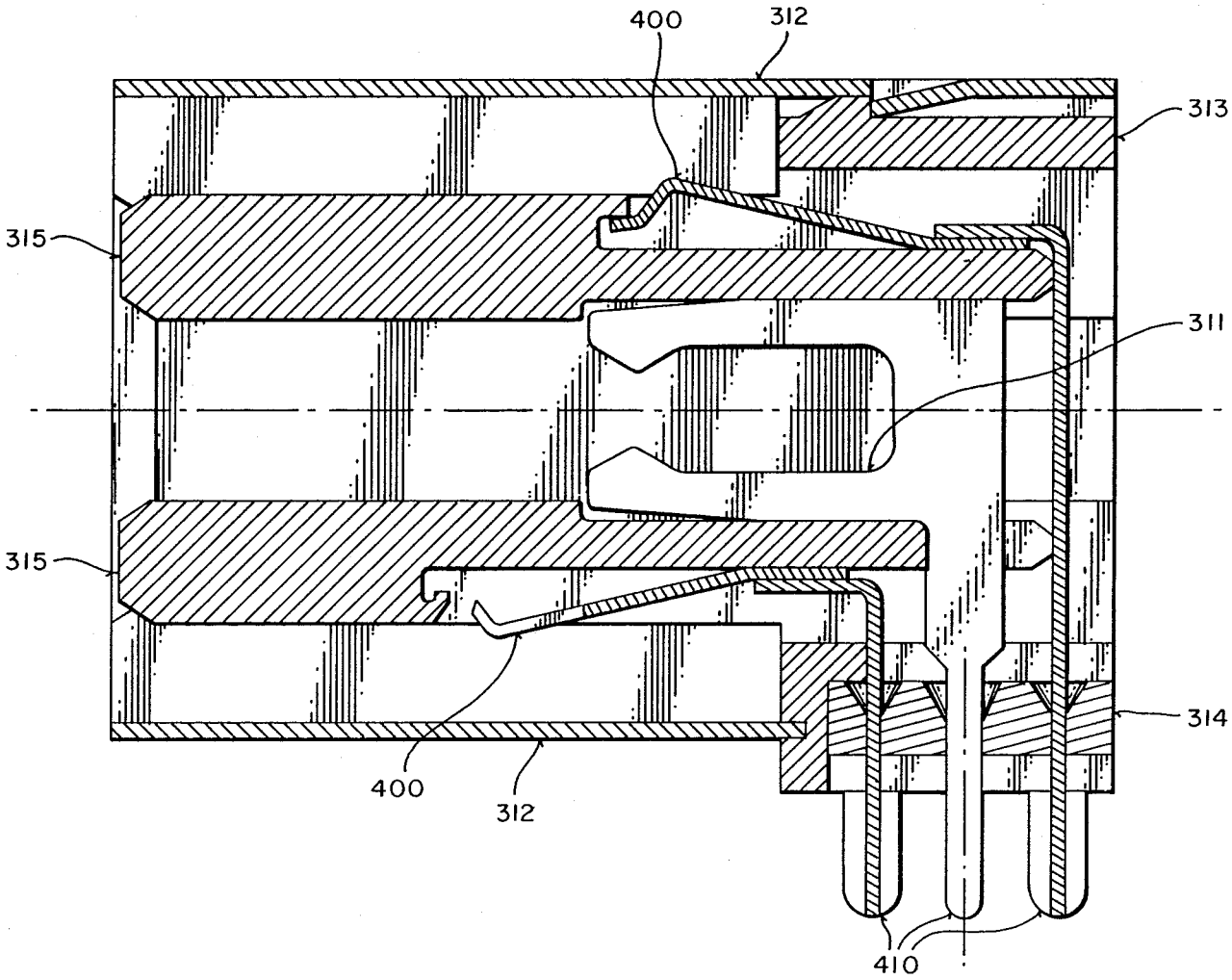
FIG. 3 shows a sectional view of a mating socket for a preferred embodiment of the connector of this invention.

FIG. 3 shows a sectional view of a mating socket for the preferred embodiment of the connector of this invention. The socket has outer tubular socket shield 312 for telescoping overlap and contacting to the tubular shield 14 of the connector when mated. This provides full electrical shielding of the connector and socket combination when mated. In other embodiments, additional contact rings can be used in place of the shield.

A tubular socket insulator 315 of a size circular shape to fit between the post and shell of a connector holds recessed leaf spring contacts 400 to contact the multiple contact rings and bands of the post 100 and shell 200. Because a ring or band is a continuous circle, a leaf spring can contact it any angular position, so long as it is properly positioned along the length of the post or shell. Leaf spring contacts 400 can face inward to contact to bands on a post 100, or can face outward to contact to rings on a shell 200. Leaf spring contacts 400 are spaced and located at different angular orientations, such as separations by 45 degrees, and in alternating inward and outward orientations, around the inner and outer diameter of tubular socket insulator 315. This provides spacing around each leaf spring contact for its mounting and recessing action, and provides separation for its signal feeds running down the tubular socket insulator 315. Where the connector has multiple shells, the socket would further have additional larger diameter tubular socket insulators, one for mating into the space between each set of shells.

Socket body sections 313 and 314 hold the tubular socket shield 312 and tubular socket insulator 315 in position for mating with a connector. The socket body also receives signal feeds from the leaf spring contacts, and provides mounting terminals 410 for electrically and mechanically mounting the socket to a printed circuit board or panel.

A snap-socket 311 is provided within the tubular socket insulator 315 for receiving the dimpled contact tip 11 of the connector. The dimpled contact tip will snap into place within the snap-socket 311 when the connector is fully inserted into the socket. This provides feedback to the user that complete coupling has been achieved, and provides a retaining action to prevent the connector from inadvertently sliding out of the socket. It is also possible by proper positioning of a set of mating contacts to insure that they will be the last electrical connection made during mating, and the first connection broken during un-mating, or vice-versa. For example, by deeply recessing the snap-socket 311 within the socket, its contact to the dimpled contact tip 11 will be the last contact during mating, and the first disconnect during un-mating. This can be used to prevent contacts from being powered up and "live" during the mating or un-mating operation, when other cross-connections can inadvertently occur as the leaf spring contacts slide over other contact bands and rings.

For a leaf spring contact, a relatively large insertion force is required during the initial deflection of the spring, but the insertion force drops off significantly once the deflection is complete and only the sliding friction is resisting the insertion. In a conventional connector with multiple leaf spring contacts, many or all of the leaf spring contacts are being deflected simultaneously, which creates a very large peak insertion force near the beginning of the insertion cycle. In the connector of this invention, only one or a few of the leaf spring contacts are being deflected simultaneously. Therefore, the peak insertion force required is very low and is more evenly spread throughout the insertion cycle.

These and other embodiments can be practiced without departing from the true scope and spirit of the invention, which is defined by the following claims.

What is claimed is:

1. A multiple contact coaxial shell connector comprising:

a post having multiple electrically conductive contact bands insulated from each other and longitudinally spaced along the length of said post;

a first shell coaxially encircling and spaced from said post, said first shell having multiple electrically conductive contact rings insulated from each other and longitudinally spaced along the length of said first shell; with said post and said first shell being fixed in coaxial position and open at a near end for access to said contact bands and rings, and mounted at a far end to a connector body.

2. A connector as in claim 1 wherein:

said contact bands conform to the outer surface diameter of said post.

3. A connector as in claim 1 wherein:

said contact rings conform to the inner surface diameter of said first shell.

4. A connector as in claim 1 wherein:

said contact rings conform to the outer surface diameter of said first shell.

5. A connector as in claim 1 further comprising:

multiple electrically conductive signal feeds insulated from each other and running lengthwise within said first shell, each signal feed connecting from a said contact ring to a terminal within said connector body.

6. A connector as in claim 1 further comprising:

a second shell, substantially similar to said first shell, and coaxially encircling and spaced outward of said first shell, said second shell having multiple electrically conductive contact rings insulated from each other and longitudinally spaced along the length of said second shell; with said contact rings conforming to the inner surface diameter of said second shell; and said contact rings conforming to the outer surface diameter of said second shell; with multiple electrically conductive signal feeds insulated from each other and running lengthwise within said second shell, each signal feed connecting from a said contact ring to a terminal within said connector body.

7. A connector as in claim 1 further comprising:

multiple electrically conductive signal feeds insulated from each other and running lengthwise within said post, each signal feed connecting from a said contact band to a terminal within said connector body.

8. A connector as in claim 7 further comprising:

an electrically conductive contact tip mounted on said near end of said post, and having an electrically conductive signal feed insulated from other said signal feeds and running lengthwise within said post, connecting from said contact tip to another said terminal within said connector body.

9. A multiple contact coaxial shell connector comprising:

a hollow tubular insulative contact-carrying first shell having an open end and an opposite closed end coupled to an insulative connector body, said first shell having a plurality of electrically conductive contact rings encircling and conforming to the inner surface of said first shell, said rings insulatively separated and longitudinally spaced along the length of said first shell; and an insulative contact-carrying post mounted coaxial and spaced within said first shell by a coupling of one end to said insulative connector body, said post having a plurality of electrically conductive contact bands encircling and conforming to the outer surface of said post, said bands insulatively separated and longitudinally spaced along the length of said post.

10. A connector as in claim 9 wherein:

said contact bands are mounted flush to the outer surface diameter of said post.

11. A connector as in claim 9 wherein:

said contact rings are mounted flush to the inner surface diameter of said first shell.

12. A connector as in claim 9 wherein:

said contact rings are mounted flush to the outer surface diameter of said first shell.

13. A connector as in claim 9 further comprising:

a plurality of electrically conductive wiring tails insulated from each other and running lengthwise within said post to connect each said contact band to a terminal within said connector body.

14. A connector as in claim 9 further comprising:

an electrically conductive contact tip on the non-coupled end of said post insulated from said contact bands and connected by a wiring tail running lengthwise within said post and insulated from other said wiring tails to connect to a terminal within said connector body.

15. A connector as in claim 9 further comprising:

a plurality of electrically conductive wiring tails insulated from each other and running lengthwise within said first shell to connect each said contact ring to a terminal within said connector body.

16. A connector as in claim 9 further comprising:

a second insulative contact-carrying shell, substantially similar to said first shell, and coaxially encircling and spaced outward of said first shell.

17. A socket for mating to a multiple contact coaxial shell connector, said socket comprising:

an outer tubular socket frame for electrically contacting a shell of said connector when mated; and a first inner tubular socket insulator mounted coaxially and spaced within said socket frame, said first socket insulator carrying electrically conductive recessed leaf spring contacts positioned along the length of said first socket insulator and spaced and located at different angular orientations around a diameter of said first socket insulator; said leaf springs to contact the multiple bands of said connector when mated, each of said leaf springs having an electrically conductive signal feed running along the length of said first socket insulator.

18. A socket as in claim 17, further comprising:

insulating socket body sections for holding said socket frame and said socket insulator in coaxial position and for receiving said signal feeds from said leaf spring contacts and coupling said signal feeds to mounting terminals for electrical and mechanical mounting of said socket.

19. A socket as in claim 17, further comprising:

a second inner tubular socket insulator mounted coaxially and spaced within said socket frame, said second socket insulator carrying electrically conductive recessed leaf spring contacts positioned along the length of said second socket insulator and spaced and located at different angular orientations around a diameter of said second socket insulator; said leaf springs to contact multiple bands of said connector when mated, each of said leaf springs having an electrically conductive signal feed running along the length of said second socket insulator.

* * * * *